US010618757B2

(12) United States Patent
Saito

(10) Patent No.: US 10,618,757 B2
(45) **Date of Patent: *Apr. 14, 2020**

(54) IMAGE PROCESSING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Yuichi Saito, Numazu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/174,391

(22) Filed: Oct. 30, 2018

(65) Prior Publication Data

US 2019/0086860 A1 Mar. 21, 2019

Related U.S. Application Data

(63) Continuation of application No. 15/705,416, filed on Sep. 15, 2017, now Pat. No. 10,146,173.

(51) Int. Cl.

| | |
|---|---|
| ***B65H 3/44*** | (2006.01) |
| ***B65H 1/04*** | (2006.01) |
| ***B65H 5/06*** | (2006.01) |
| ***B65H 15/00*** | (2006.01) |
| ***B65H 85/00*** | (2006.01) |

(52) U.S. Cl.

CPC ..... *B65H 3/44* (2013.01); *B65H 1/04* (2013.01); *B65H 5/062* (2013.01); *B65H 15/00* (2013.01); *B65H 85/00* (2013.01); *B65H 2402/441* (2013.01); *B65H 2403/42* (2013.01); *B65H 2405/324* (2013.01); *B65H 2407/21* (2013.01); *B65H 2601/252* (2013.01); *B65H 2801/06* (2013.01)

(58) Field of Classification Search

CPC ..... B65H 3/44; B65H 15/00; B65H 85/00; B65H 1/04; B65H 5/062; B65H 2402/31; B65H 2402/45; B65H 2407/21; B65H 2801/06; G03G 21/1633; G03G 21/1638

USPC ..... 271/9.09, 9.13, 3.14, 4.01, 65, 291

See application file for complete search history.

(56) References Cited

U.S. PATENT DOCUMENTS 5,418,606 A 5/1995 Kikuchi et al.
9,037,073 B2 5/2015 Aoyama
(Continued)

*Primary Examiner* — David H Bollinger
(74) *Attorney, Agent, or Firm* — Amin, Turocy & Watson, LLP

(57) ABSTRACT

In accordance with an embodiment, an image processing apparatus comprises a first opening and closing member, a second opening and closing member, a first tooth section, a second tooth section, and an intermediary tooth section. The first opening and closing member is opened and closed with respect to an apparatus main body with a first hinge as the center. The second opening and closing member is opened and closed with a second hinge arranged in the first opening and closing member as the center. The first tooth section comprises a plurality of teeth fixed coaxially with the first hinge. The second tooth section comprises a plurality of teeth supported coaxially with the second hinge. The intermediary tooth section is engaged with the first tooth section and the second tooth section between the first tooth section and the second tooth section.

16 Claims, 9 Drawing Sheets

(56) References Cited

U.S. PATENT DOCUMENTS

| | | | | |
|---|---|---|---|---|
| 9,411,294 | B2 | 8/2016 | Aoyama | |
| 10,146,173 | B1 * | 12/2018 | Saito | B65H 5/062 |
| 2005/0040583 | A1 | 2/2005 | Murakami et al. | |
| 2007/0164500 | A1 | 7/2007 | Lim | |

* cited by examiner

IMAGE PROCESSING APPARATUS

CROSS-REFERENCE TO RELATED APPLICATIONS

This application is a Continuation of application Ser. No. 15/705,416 filed on Sep. 15, 2017, the entire contents of which are incorporated herein by reference.

FIELD

Embodiments described herein relate generally to an image processing apparatus.

BACKGROUND

Conventionally, an image forming apparatus is provided with an opening and closing member that is openable/closable on a side surface of an apparatus main body. An openable/closable manual tray is provided in the opening and closing member. A printer or a scanner is known as the image forming apparatus. There are times when a paper jam occurs in which a sheet (paper) is jammed in a conveyance mechanism or processing mechanism inside the image forming apparatus. The opening and closing member can be opened and closed in order to remove a jammed sheet or clean or replace each unit. By releasing a lock mechanism at an upper side of the opening and closing member, the opening and closing member is opened with a hinge at a lower side as the center. A hinge for opening and closing the manual tray is separately provided in the opening and closing member. By opening the manual tray of a manual sheet feed device, a sheet inserted manually into the apparatus main body can be placed on the manual tray.

In the image forming apparatus, the hinge for opening and closing the manual tray is provided at the midway part of the opening and closing member in the length direction. There are times when the opening and closing member is opened in a state where the manual tray is opened to place a sheet for manual insertion. In this case, there are problems that the manual tray is inclined downwards interlocking with the opening operation of the opening and closing member and the sheet undesirably slides down from the manual tray.

In another conventional image forming apparatus, a manual tray is provided obliquely and upwards in a state where the opening and closing member is closed in the apparatus main body. When the opening and closing member is opened from the closed position, the interlocked manual tray is held at the horizontal position. This image forming apparatus couples the apparatus main body with the opening and closing member by a link member in an openable/closable manner. The opening and closing member and the manual tray are coupled by a linear member. When the opening and closing member is opened in the opening state of the manual tray, the linear member passes through a through hole arranged in the opening and closing member such that it is prevented that the manual tray is inclined downwards from the horizontal direction.

However, such an image forming apparatus has a complex structure since the link member and the linear member are used. Moreover, since the link member and the linear member protrude to the upper part of the opened opening and closing member, work such as removal of a jammed sheet, cleaning, or exchange of each unit and the like is undesirably hindered.

DETAILED DESCRIPTION

In accordance with an embodiment, an image processing apparatus comprises a first opening and closing member, a second opening and closing member, a first tooth section, a second tooth section, and an intermediary tooth section. The first opening and closing member is opened and closed with respect to an apparatus main body with a first hinge as the center. The second opening and closing member is opened and closed with a second hinge arranged in the first opening and closing member as the center. The first tooth section comprises a plurality of teeth fixed coaxially with the first hinge. The second tooth section comprises a plurality of teeth supported coaxially with the second hinge. The second tooth section can be rotated. The intermediary tooth section is engaged with the first tooth section and the second tooth section to rotate between the first tooth section and the second tooth section.

Hereinafter, an image forming apparatus according to an embodiment is described with reference to the accompanying drawings.

Figure 1:
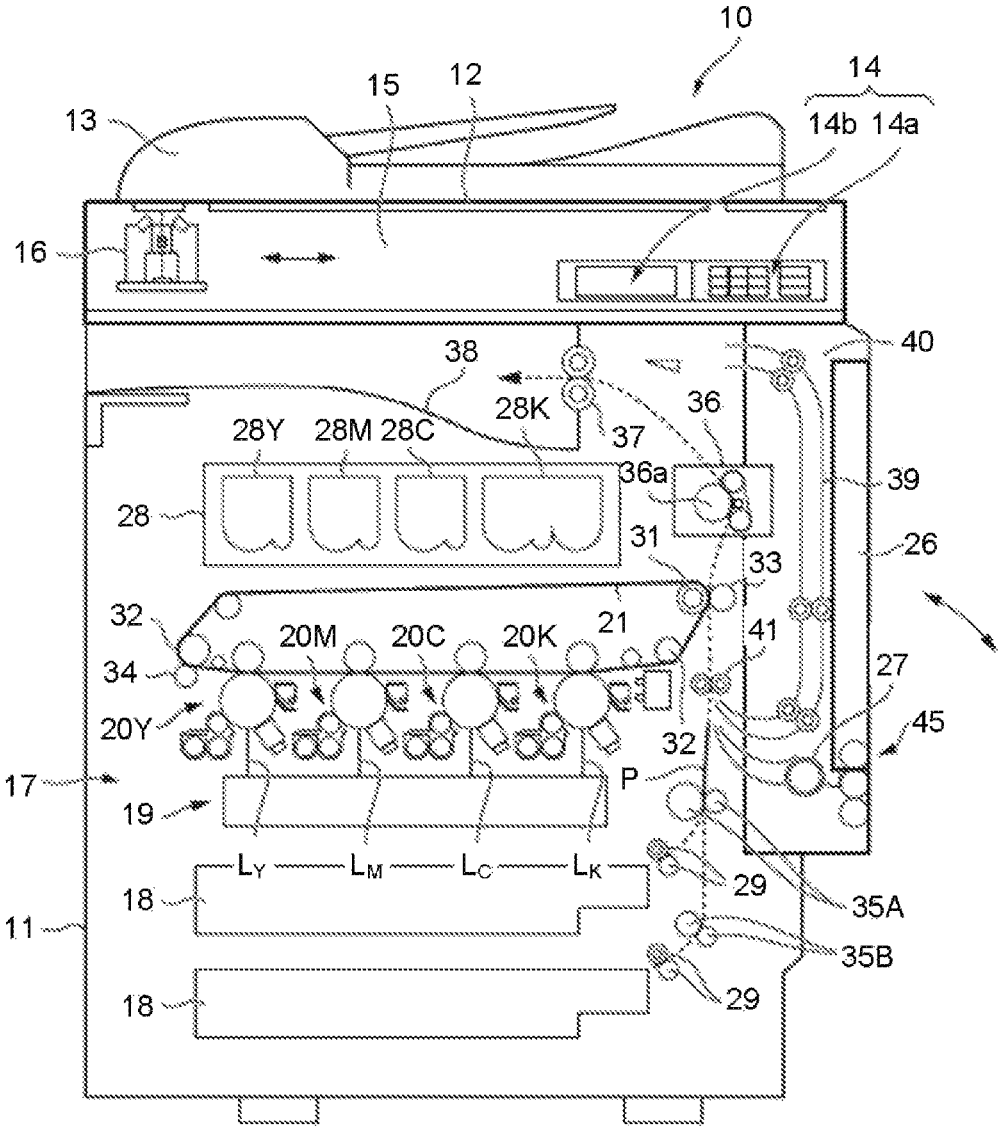
FIG. 1 is a schematic diagram illustrating a constitution of an image forming apparatus according to a first embodiment.

With reference to FIG. 1 to FIG. 7, an image forming apparatus 10 according to a first embodiment is described. FIG. 1 is a schematic diagram illustrating a constitution of the image forming apparatus 10.

FIG. 1 is a schematic diagram of a cross section illustrating an example of a constitution of the image forming apparatus 10 according to the first embodiment. In FIG. 1, for ease of viewing, dimensions and shapes of each member are exaggerated or simplified (the same applies to other drawings).

As shown in FIG. 1, the image forming apparatus 10 according to the first embodiment is, for example, an MFP (Multi-Function Peripheral), a printer or a copier. Hereinafter, an example of a case in which the image forming apparatus 1 is the MFP is described.

A document table 12 including transparent glass is arranged at an upper part of an apparatus main body 11 of the image forming apparatus 10. An automatic document feeder (ADF) 13 is arranged on the document table 12. An operation section 14 is arranged at an upper part of the apparatus main body 11. The operation section 14 includes an operation panel 14*a* having various keys and a touch panel type display section 14*b*.

A scanner section 15 serving as a reading device is arranged at a lower part of the automatic document feeder 13. The scanner section 15 reads a document sent by the automatic document feeder 13 or a document placed on the document table 12. The scanner section 15 generates image data of a document. For example, the scanner section 15 includes an image sensor 16. For example, the image sensor 16 may be a contact type image sensor.

The image sensor 16 moves along the document table 12 in the case of reading an image of a document placed on the document table 12. The image sensor 16 reads a document image line by line and thus reads a document of one page. The image sensor 16 reads, in the case of reading an image of a document sent by the ADF 13, the sent document at a fixed position shown in FIG. 1.

The apparatus main body 11 of the image forming apparatus 10 includes a printer section 17 at a central part in the height direction. The apparatus main body 11 includes sheet feed cassettes 18 (sheet housing sections) at a lower part thereof and a manual tray 26. The sheet feed cassettes 18 are arranged inside the apparatus main body 11. The number of the sheet feed cassettes 18 may be preferably one or more. In the example shown in FIG. 1, two sets of sheet feed cassettes 18 are arranged in the vertical direction.

The manual tray 26 is openable and closable. The manual tray 26 is arranged at one side of the apparatus main body 11 and provided in an automatic duplex device 40 described later. The automatic duplex device 40 is also openable and closable. The manual tray 26 is suitable for supplying large sheets that are not received in the sheet feed cassette 18, special sheets, a small number of nonstandard sheets and the like. The manual tray 26 is stored in the automatic duplex device 40 when the manual tray 26 is not used, and is opened to a horizontal position when the manual tray 26 is used. The manual tray 26 in use may be inclined upwards or downwards but not horizontally.

Each of the sheet feed cassettes 18 houses various sizes of sheets P. each of the sheet feed cassettes 18 and the manual tray 26 house various sizes of sheets P on a center positioning basis.

Sizes of the sheets P housed in each of the sheet feed cassettes 18 and the manual tray 26 are detected by a sheet size detection mechanism (not shown). Various different sheets P may be housed in each of the sheet feed cassettes 18 and the manual tray 26. As an example of a type of sheets P, a type based on a thickness of the sheet P is exemplified. For example, the type of the sheets P housed in each of the sheet feed cassettes 18 and the manual tray 26 may be input via the operation panel 14*a* or the display section 14*b*.

A conveyance mechanism 29 (conveyance section) is arranged in the vicinity of each of the sheet feed cassettes 18 in the apparatus main body 11. The conveyance mechanism 29 feeds a sheet P fed from the sheet feed cassette 18 to a main body conveyance route. The conveyance mechanism 29 uses a suitable constitution capable of preventing that the sheet P is fed again. For example, a constitution of a FRR sheet feed system may be used as the constituted of the conveyance mechanism 29.

The manual tray 26 includes a manual conveyance mechanism 27. The manual conveyance mechanism. 27 takes out sheets P from the manual tray 26 one by one and sends the picked up sheets P to the main body conveyance route.

In the following description, a direction orthogonal to a conveyance direction of a sheet P along a conveyance surface of the sheet P in the image forming apparatus 10 is referred to as a "conveyance orthogonal direction".

The printer section 17 forms an image on the sheet P on the basis of image data read by the scanner section 15 or image data created by a personal computer. The transfer section 17 is, for example, a color printer based on a tandem system.

The printer section 17 includes image forming sections 20Y, 20M, 20C and 20K of respective colors of Yellow (Y), magenta (M), cyan (C), black (K), an exposure device 19 and an intermediate transfer belt 21.

The image forming sections 20Y, 20M, 20C and 20K are arranged below the intermediate transfer belt 21. The image forming sections 20Y, 20M, 20C and 20K are arranged in parallel from the upstream side along the downstream side in a moving direction (in a direction from the left side to the right side shown) below the intermediate transfer belt 21.

The exposure device 19 irradiates exposure light LY, LM, LC and LK to the image forming sections 20Y, 20M, 20C and 20K, respectively. The exposure device 19 may be constituted in such a way to generate a laser scanning beam as exposure light. The exposure device 19 may include a solid-state scanning element such as a LED that generates exposure light. The constitutions of the image forming sections 20Y, 20M, 20C and 20K are common to each other except that colors of toner are different.

The image forming sections 20Y, 20M, 20C and 20K each commonly include a well-known electrophotographic type device constitution. For example, the image forming sections 20Y, 20M, 20C and 20K each include a photoconductive drum. A charger, a developing device, a primary transfer roller, a cleaner and a blade are arranged around the photoconductive drum in a rotation direction of the photoconductive drum.

The charger uniformly charges the surface of the photoconductive drum. The exposure device 19 generates exposure light modulated on the basis of image date of each color. The exposure light exposes the surface of the photoconductive drum. The exposure device forms an electrostatic latent image on the photoconductive drum. The developing device supplies toner to the photoconductive drum by a developing roller to which a developing bias is applied. The developing device develops the electrostatic latent image on the photoconductive drum. The cleaner includes a blade abutting against the photoconductive drum. The blade removes toner left on the surface of the photoconductive drum.

As shown in FIG. 1, a toner cartridge 28 is arranged above the image forming sections 20Y, 20M, 20C and 20K.

The toner cartridge 28 supplies toner to the respective developing devices of the image forming sections 20Y, 20M, 20C and 20K, respectively. The toner cartridge 28 includes toner cartridges 28Y, 28M, 28C and 28K. The toner cartridges 28Y, 28M, 28C and 28K house yellow toner, magenta toner, cyan toner and black toner, respectively.

The intermediate transfer belt 21 moves circularly. The intermediate transfer belt 21 is stretched over a drive roller 31 and a plurality of driven rollers 32. The middle transfer belt 21 is in contact with each of the photoconductive drums of the image forming sections 20Y, 20M, 20C and 20K from the upper side shown. A primary transfer roller of each of the image forming sections 20Y, 20M, 20C and 20K is arranged inside the intermediate transfer belt 21 at a position opposite to each of the photoconductive drums in the intermediate transfer belt 21.

Each of the primary transfer rollers primarily transfers a toner image on the photoconductive drum to the intermediate transfer belt 21 if a primary transfer voltage is applied. The photoconductive drum constitutes an image carrier for carrying the toner image from a developing position to a primary transfer position.

A secondary transfer roller 33 is opposite to the drive roller 31 across the intermediate transfer belt 21. An abutting section of the intermediate transfer belt 21 and the secondary transfer roller 33 constitutes a secondary transfer position. The drive roller 31 drives the intermediate transfer belt 21 to rotate. The intermediate transfer belt 21 driven to rotate constitutes an image carrier for carrying the toner image from the primary transfer position to the secondary transfer position.

A secondary transfer voltage is applied to the secondary transfer roller 33 when the sheet P passes through the secondary transfer position. If the secondary transfer voltage is applied to the secondary transfer roller 33, the secondary transfer roller 33 secondarily transfers the toner image on the intermediate transfer belt 21 to the sheet P.

As shown in FIG. 1, a belt cleaner 34 is arranged in the vicinity of the driven roller 32. The belt cleaner 34 removes transfer toner remaining on the intermediate transfer belt 21 from the intermediate transfer belt 21.

Conveyance rollers 35B and 35A and a register roller 41 are arranged on a main body conveyance route from each of the sheet feed cassettes 18 to the secondary transfer roller 33. The conveyance roller 35B conveys, towards the conveyance roller 35A, the sheet P picked up from the lower sheet feed cassette 18. The conveyance roller 35A conveys, towards the register roller 41, the sheet P picked up from the lower or upper sheet feed cassette 18, respectively.

The register roller 41 aligns positions of front ends of the sheets P conveyed by the conveyance roller 35A. The register roller 41 conveys the sheet P such that the front end of the transfer area of the toner image of the sheet P reaches the secondary transfer position. The transfer area of the toner image is an area excluding a forming area of an end part void of the sheet P.

A conveyance route is formed by a conveyance guide between the manual conveyance mechanism 27 and the register roller 41. The manual conveyance mechanism 27 conveys, towards the conveyance guide, the sheet P picked up from the manual tray 26. The sheet P moving along the conveyance guide reaches the register roller 41.

A fixing device 36 is arranged at the downstream side (upper side shown) of the secondary transfer roller 33 in the conveyance direction of the sheet P. A conveyance roller 37 is arranged at the downstream side (upper left side shown) of the fixing device 36 in the conveyance direction of the sheet P. The conveyance roller 37 discharges the sheet P to a sheet discharge section 38.

The fixing device 36 fixes the toner image on the sheet P. The fixing device 36 fixes the toner image by heating and pressuring the toner image on the sheet P. For example, a constitution of a well-known roller fixing system may be used as the constitution of the fixing device 36. For example, a constitution of a well-known belt fixing system may be used as the constitution of the fixing device 36. The fixing device 36 at least includes a heat roller 36*a*, a heat source and a temperature detection sensor. The heat roller 36*a* heats the roller image. The heat source heats the heat roller 36*a*. The temperature detection sensor detects a temperature of the heat roller 36*a*.

A reversal conveyance route 39 is arranged at the downstream side (right side shown) of the fixing device 36 in the conveyance direction of the sheet P. The reversal conveyance route 39 reverses the sheet P to guide the reversed sheet P to the upstream side of the register roller 41. The reversal conveyance route 39 is used at the time of execution of duplex printing. The reversal conveyance route 39 is arranged in the automatic duplex device 40. If the automatic duplex device 40 is opened to the outside of the apparatus main body 11, the reversal conveyance route 39 is also opened integrally.

Next, the automatic duplex device 40 and the manual tray 26 are described.

Figure 4A:
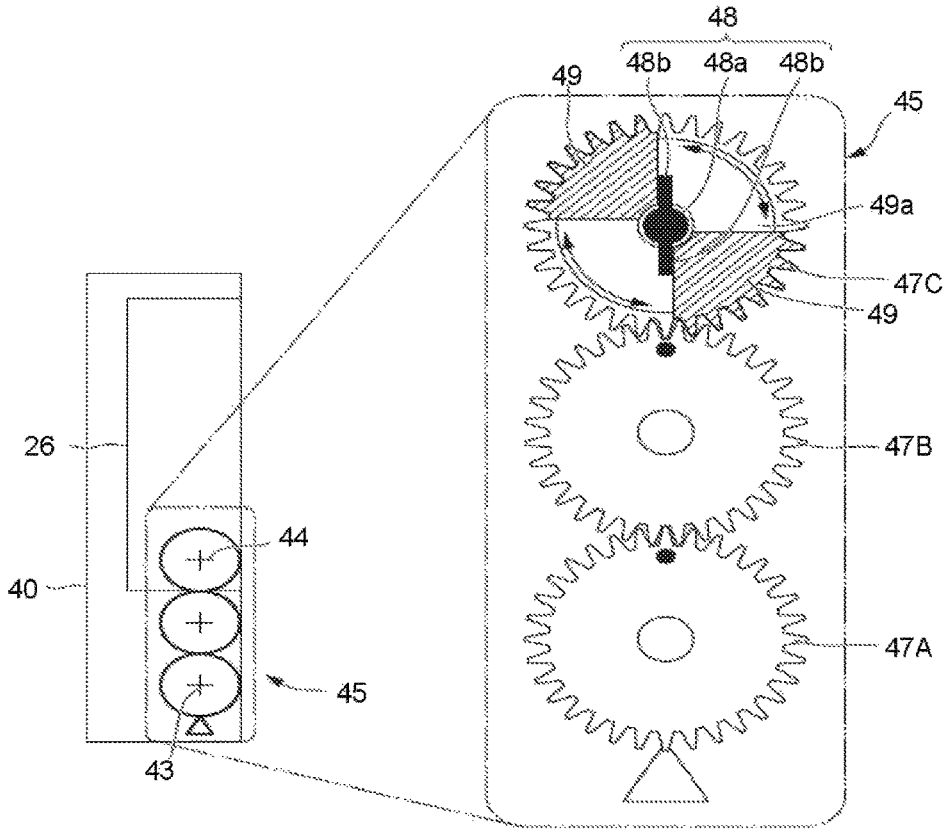
FIG. 4A is a view illustrating a gear device for opening and closing the automatic duplex device and the manual tray of the image forming apparatus according to the first embodiment.

As shown in FIG. 1 and FIG. 4A, the automatic duplex device 40 can be opened and closed to the outside with a first hinge 43 provided in a lower part of the outer side thereof as the center. The first hinge 43 is provided in the apparatus main body 11. The manual tray 26 in the outer side surface of the automatic duplex device 40 is arranged to be openable and closable to the outside with a second hinge 44 provided in a lower part of the outer side thereof as the center. The second hinge 44 is provided in the automatic duplex device 40. The manual tray 26 can be opened and closed integrally in a state of being stored in the automatic duplex device 40. The manual tray 26 can be separately opened and closed with respect to the automatic duplex device 40.

FIG. 2 and FIG. 3 are views illustrating opening operations of the automatic duplex device 40 and the manual tray 26.

Figure 2A:
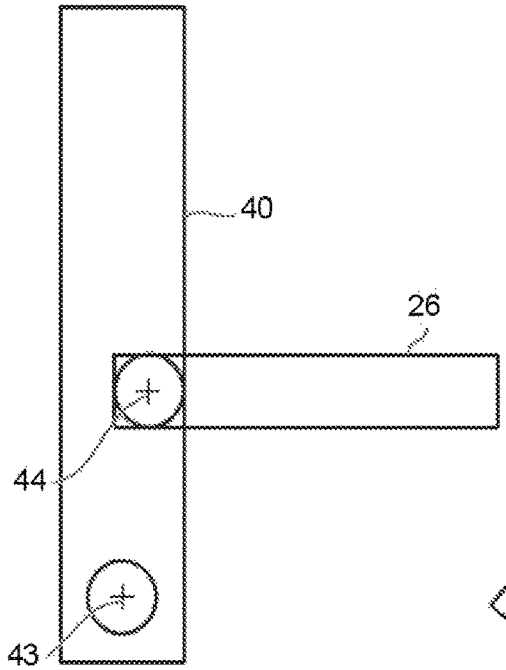
FIG. 2(A) and FIG. 2(B) are views illustrating opening operations of an automatic duplex device and a manual tray of a conventional image forming apparatus.
Figure 2B:
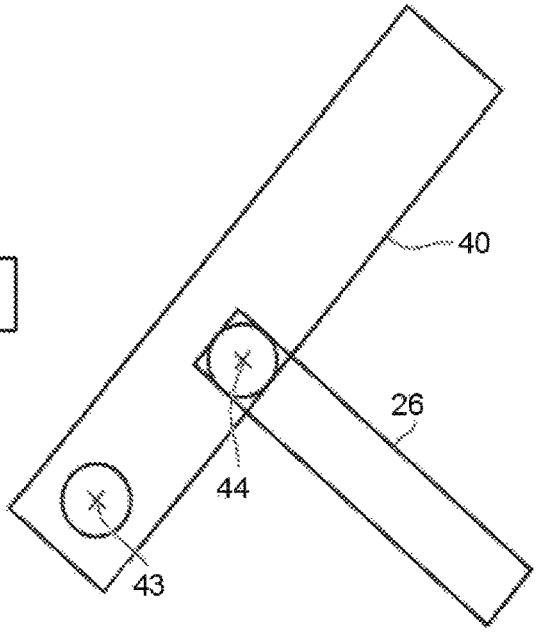

In the schematic diagrams of the conventional example shown in FIG. 2(A) and FIG. 2(B), the manual tray 26 is located at an opening position with respect to the automatic duplex device 40 located at a closing position. If the automatic duplex device 40 is opened by the first hinge 43 from this state, the manual tray 26 is interlocked to be inclined downwards. The sheet P placed on the manual tray 26 drops.

Figure 3A:
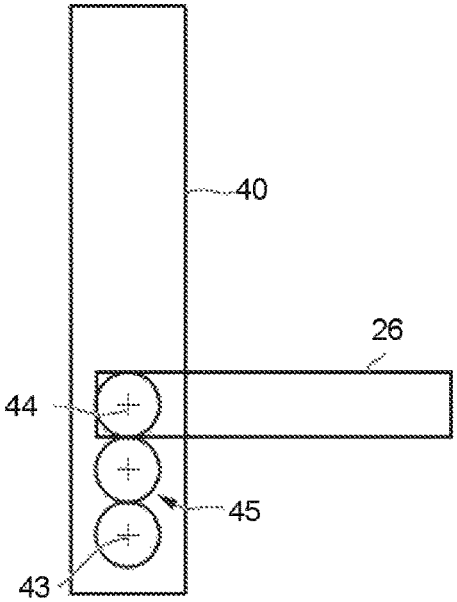
FIG. 3(A) and FIG. 3(B) are views illustrating opening operations of an automatic duplex device and a manual tray of the image forming apparatus according to the embodiment.
Figure 3B:
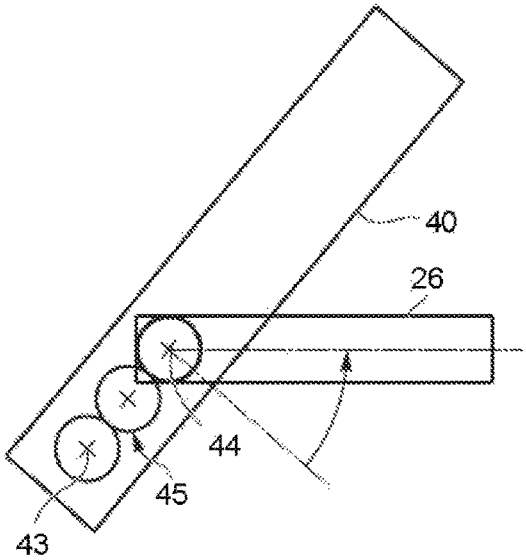

In the schematic diagrams of the embodiment shown in FIG. 3(A) and FIG. 3(B), the automatic duplex device 40 is opened with the first hinge 43 as the center from a state where the manual tray 26 is located at the opening position. Thus, the manual tray 26 is rotated relatively at the automatic duplex device 40 side with the second hinge 44 as the center through movement of a gear device 45. Since the manual tray 26 moves to a horizontal position or an upward inclined position, the sheet P does not drop.

In FIG. 4A, the gear device 45 is provided in a lower part of the outer side of the automatic duplex device 40. For example, three toothed gears of the gear device 45 are arranged linearly to be engaged with each other. The gear device 45 is composed of a first toothed gear 47A, an intermediary toothed gear 47B and a second toothed gear 47C. The first toothed gear 47A is provided coaxially with the first hinge 43. The first toothed gear 47A is fixedly arranged without rotating. The intermediary toothed gear 47B is arranged between the first toothed gear 47A and the second toothed gear 47C, and engaged with the first toothed gear 47A and the second toothed gear 47C. The second toothed gear 47C is provided coaxially with the second hinge 44. For example, the first toothed gear 47A, the intermediary toothed gear 47B and the second toothed gear 47C have the same outer diameter, and are arranged with the same number of teeth. An imaginary line for connecting respective centers of the first toothed gear 47A, the intermediary toothed gear 47B and the second toothed gear 47C is set to a central axis O. The central axis O is positioned in a perpendicular direction in FIG. 4A. The gear device 45 at this position is set to a reference position.

FIG. 4A schematically shows that the first hinge 43 and the second hinge 44 are overlapped with central shafts of the first toothed gear 47A and the second toothed gear 47C. If the automatic duplex device 40 is rotated with the first hinge 43 as the center, the first toothed gear 47A and the intermediary toothed gear 47B and the second toothed gear 47C of the gear device 45 are rotated integrally. Since the first toothed gear 47A is fixed, the intermediary toothed gear 47B revolves while engaged with the teeth of the first toothed gear 47A to rotate. The second toothed gear 47C rotates at an opposite side to the intermediary toothed gear 47B while revolving integrally with the intermediary toothed gear 47B.

A coupling shaft 48 coupled with two ends of the rotational shaft of the manual tray 26 is supported by the central shaft of the second toothed gear 47C. A shaft section 48*a* coaxial with the second hinge 44 and abutting pins (abutting sections) 48*b* protruding to positions opposite to each other at an angle of 180 degrees are provided in the coupling shaft 48. Two sets of pressing sections 49 are arranged at positions opposite to each other at an angle of 180 degrees on the inner surface of the second toothed gear 47C. The pressing sections 49 are set to be in an approximate fan shape with a width of 90 degrees, and two sets of spaces of 90 degrees are arranged between the pressing sections 49. The abutting pins 48*b* of the coupling shaft 48 are arranged in the spaces, respectively. The abutting pins 48*b* are pressed by the pressing sections 49 through the rotation of the second toothed gear 47C and the manual tray 26 is rotated.

Figure 4B:
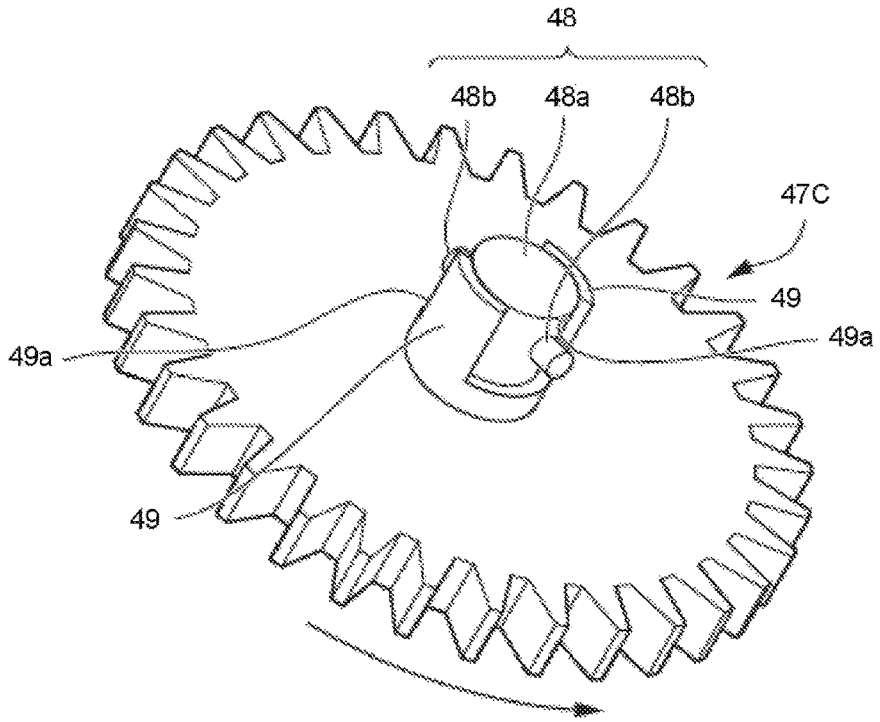
FIG. 4B is a perspective view illustrating a concrete example of a second toothed gear.

FIG. 4B illustrates a concrete example of the second toothed gear 47C.

The substantially cylindrical pressing sections 49 are formed at the center of the second toothed gear 47C. Spaces 49*a* composed of notches are formed in the pressing sections 49. The coupling shaft 48 coupled with the rotational shaft of the manual tray 26 is inserted inside the pressing sections 49. The coupling shaft 48 includes the shaft section 48*a* inserted into the pressing sections 49 in a relatively rotatable manner and the abutting pins 48*b* protruding from the shaft section 48*a* to the spaces (notches) 49*a*. If the abutting pins 48*b* are pressed by the pressing sections 49 through the rotation of the second toothed gear 47C, the shaft section 48*a* is rotated. The manual tray 26 is rotated through the rotation of the shaft section 48*a*.

Figure 6:
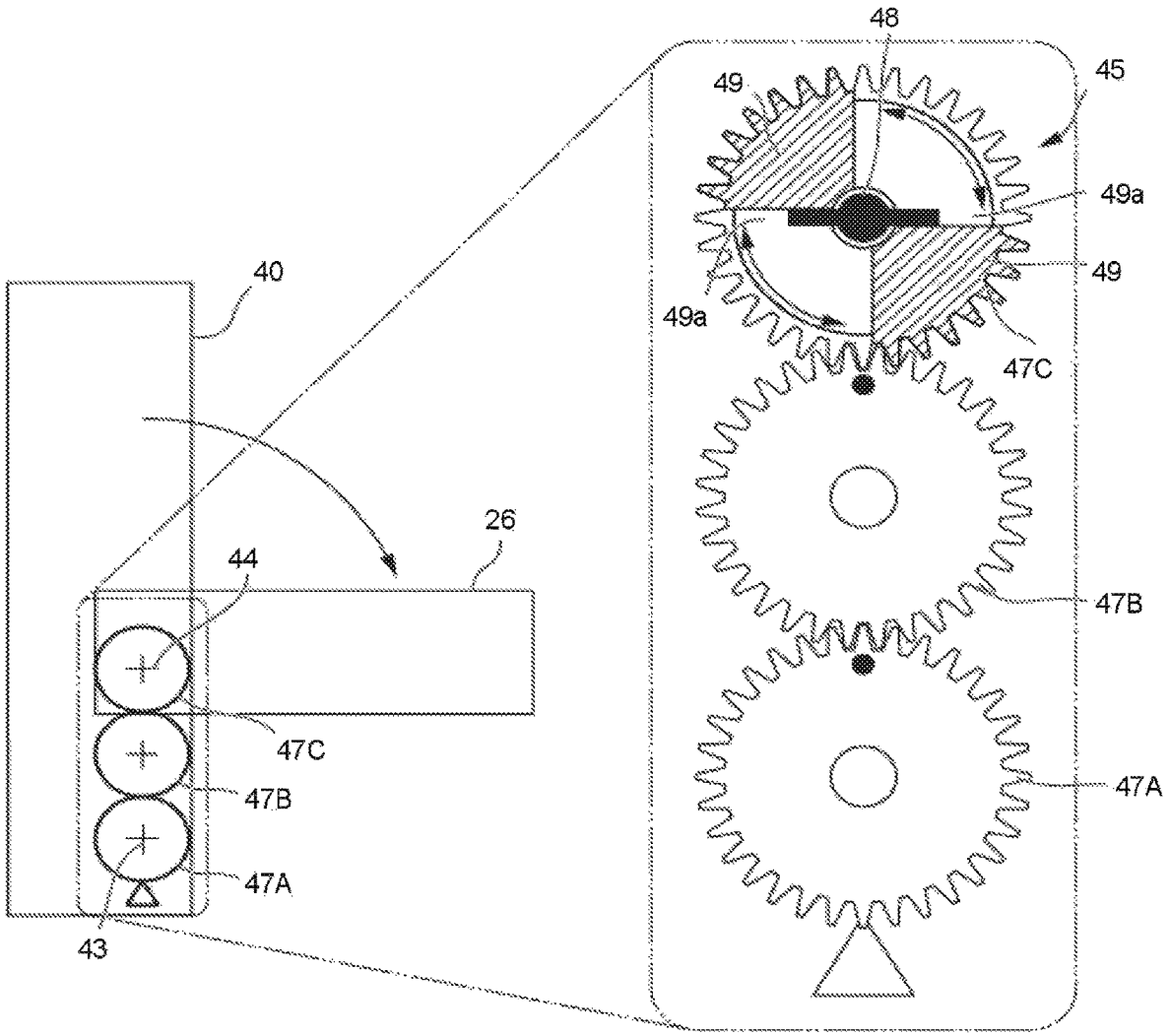
FIG. 6 is a view illustrating an operating for opening the manual tray of the image forming apparatus according to the embodiment.

It is possible to adjust an angle of the manual tray 26 through cooperation of the abutting pins 48*b* of the coupling shaft 48 and the pressing sections 49 of the second toothed gear 47C. As shown in FIG. 6, in a case in which the abutting pins 48*b* of the coupling shaft 48 are rotated inside the spaces 49*a* of the pressing sections 49, an opening angle of the manual tray 26 can be adjusted without rotating the second toothed gear 47C.

Figure 5:
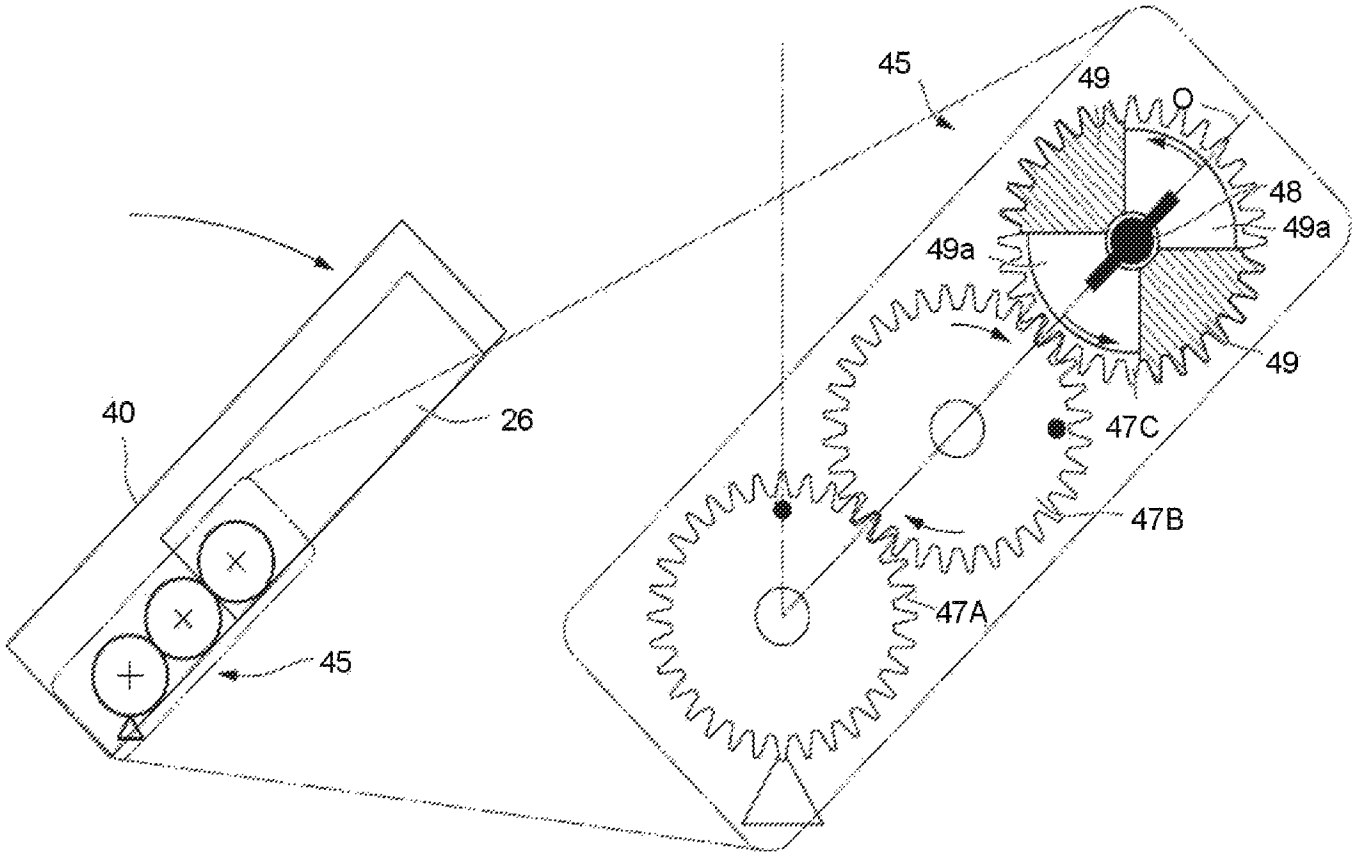
FIG. 5 is a view illustrating an operating for opening the automatic duplex device of the image forming apparatus according to the embodiment.

Next, FIG. 5 illustrates a case in which the opening operation of the automatic duplex device 40 is carried out in a state where the manual tray 26 is stored in the automatic duplex device 40.

For example, the automatic duplex device 40 is rotated by 45 degrees with the first hinge 43 as the center to be opened. The central axis O of the three toothed gears of the gear device 45 is inclined by 45 degrees. In the gear device 45, the intermediary toothed gear 47B revolves with the first hinge 43 as the center while rotating in the clockwise direction along the teeth of the fixed first toothed gear 47A. The intermediary toothed gear 47B is rotated by 90 degrees. The second toothed gear 47C revolves in the clockwise direction while rotating in the counterclockwise direction in the reverse direction to the intermediary toothed gear 47B. Therefore, the second toothed gear 47C has the same gesture as the reference position at a position inclined by 45 degrees. The coupling shaft 48 of the manual tray 26 is positioned in the direction of the central axis O inclined by 45 degrees.

The opening position of the automatic duplex device 40 is not limited to the inclined position of 45 degrees, and may be a position at which it is opened at an angle greater than or smaller than 45 degrees. For example, the automatic duplex device 40 may be opened until 90 degrees to be positioned in the horizontal direction. In this case, the manual tray 26 is stored in the automatic duplex device 40. The automatic duplex device 40 may be opened at an angle greater than 90 degrees.

In FIG. 6, the automatic duplex device 40 is located at the closing position. The manual tray 26 is rotated by 90 degrees to be held at the horizontal position.

The sheet P can be placed on the manual tray 26 and inserted into the manual tray 26 at this position. The coupling shaft 48 is rotated inside the spaces (notches) 49*a* of the pressing section 49 by, for example, 90 degrees. The abutting pin 48*b* is rotated by 90 degrees from one pressing section 49 and abuts against the other pressing section 49. The abutting pin 48*b* is rotated from the vertical position and stops at the horizontal position. The manual tray 26 is rotated by 90 degrees with the second hinge 44 as the center. The second toothed gear 47C is not rotated.

Figure 7:
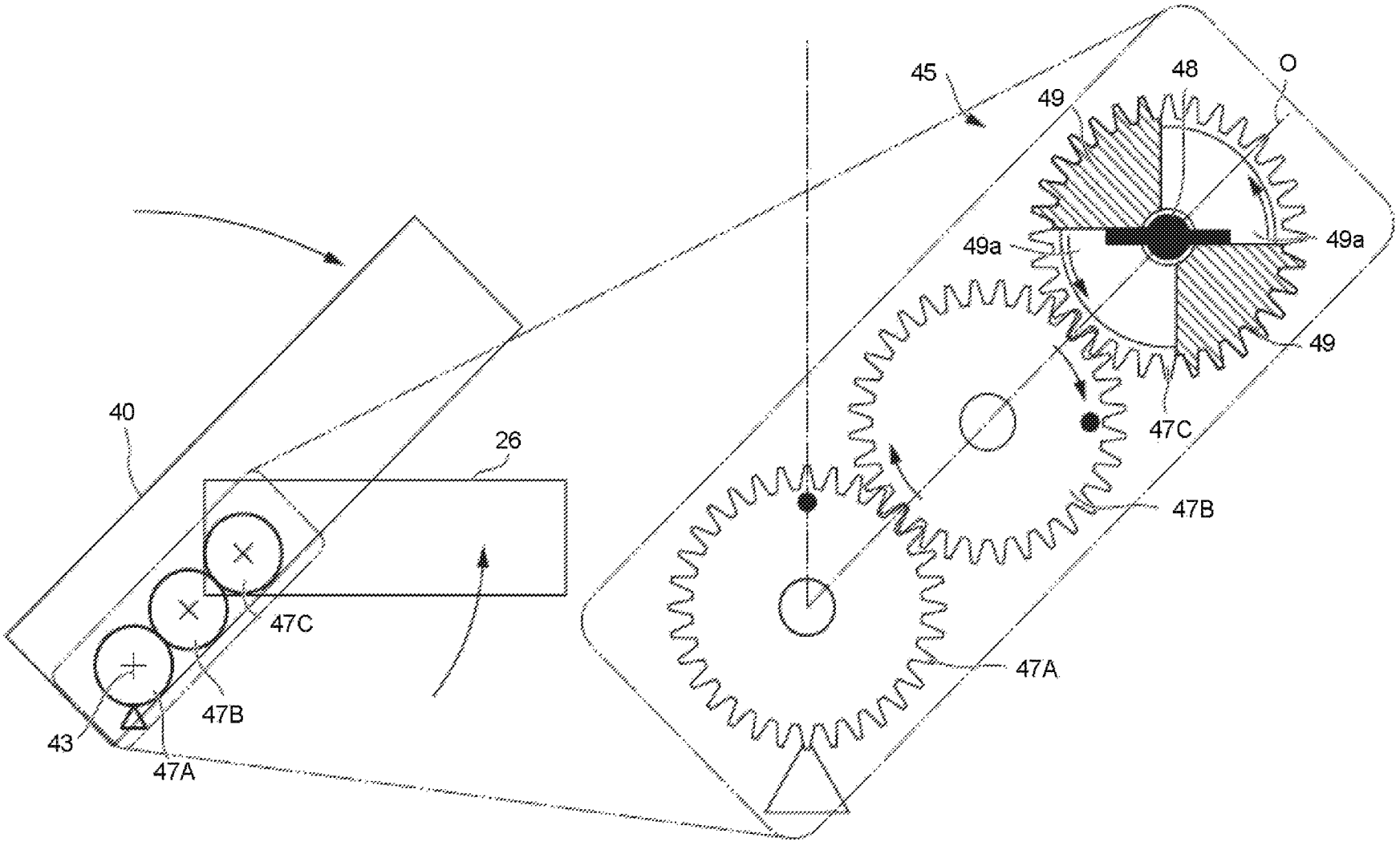
FIG. 7 is a view illustrating an operating for opening the automatic duplex device in a state of opening the manual tray of the image forming apparatus according to the first embodiment.

There are times when the sheet P is jammed within the apparatus main body 11. In this case, as shown in FIG. 7, an operation for opening the automatic duplex device 40 is carried out from a state where the manual tray 26 is opened. The opening operation of the automatic duplex device 40 with the first hinge 43 as the center is carried out. Thus, the gear device 45 is rotated integrally with the automatic duplex device 40.

In FIG. 7, the intermediary toothed gear 47B revolves in the clockwise direction while engaged with the tooth section of the fixed first toothed gear 47A to rotate in the clockwise direction. The second toothed gear 47C engaged with the intermediary toothed gear 47B revolves in the clockwise direction while rotating in the counterclockwise direction. The manual tray 26 is rotated in the clockwise direction from the horizontal state to be inclined downwards integrally with the rotation of the automatic duplex device 40. At the same time, the second toothed gear 47C is interlocked with the rotation of the intermediary toothed gear 47B to rotate in the counterclockwise direction. The abutting pins 48*b* of the coupling shaft 48 are pressed by the pressing sections 49 integrally rotating with the second toothed gear 47C in the counterclockwise direction to be raised. The manual tray 26 is rotated in the closing direction at the same angle as the opening angle of the automatic duplex device 40 through the rotation of the coupling shaft 48. Therefore, the manual tray 26 is held in the horizontal state. The sheet P placed on the manual tray 26 can be prevented from sliding down. The pressing sections 49 of the second toothed gear 47C are held in the same gesture.

According to the present embodiment described above, when the automatic duplex device 40 operates in an opening direction, the manual tray 26 at the opening position operates in a closing direction through the interlocking action of the gear device 45. The manual tray 26 at the opening position is held at the opening position even if it opens the automatic duplex device 40 from the closing position to the opening position. Therefore, the sheet P placed on the manual tray 26 at the opening position can be prevented from dropping or sliding down.

In the present embodiment, the downward inclination of the manual tray 26 at the opening position can be prevented by the gear device 45 set inside the automatic duplex device 40. Since a link member or a linear member is not used in a conventional example, the constitution is simpler and smaller than the conventional example. In a state where the automatic duplex device 40 is opened, work for removing a jammed sheet, component exchange or component repair is not hindered.

Next, other embodiments or modifications of the embodiment described above are described with reference to FIG. 8 to FIG. 10.

Figure 8:
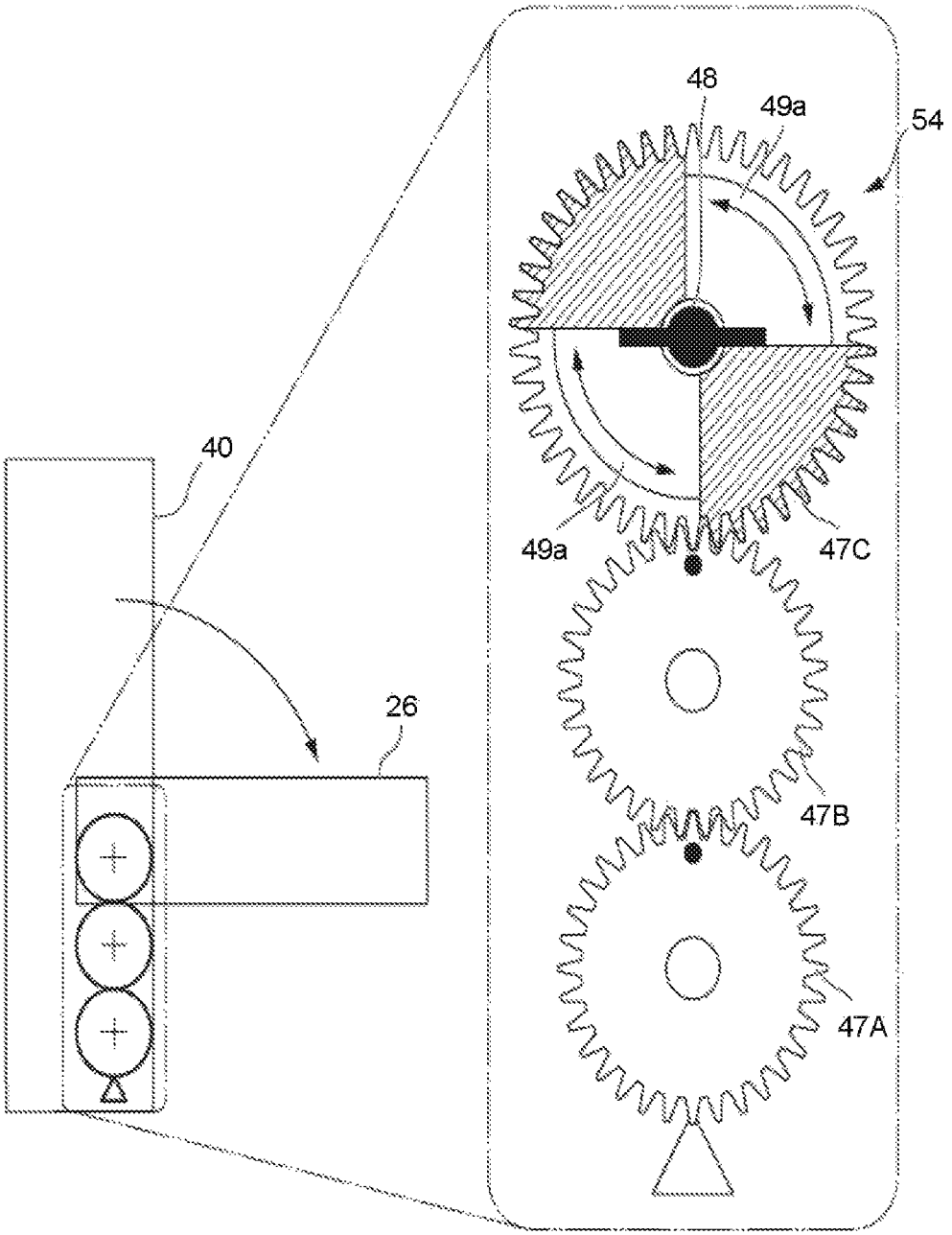
FIG. 8 is a view illustrating a gear device of an image forming apparatus according to a second embodiment.

FIG. 8 illustrates a gear device 54 of the image forming apparatus 10 according to a second embodiment In the gear device 54, the second toothed gear 47C has a larger outer diameter size and a greater number of teeth than the first toothed gear 47A and the intermediary toothed gear 47B. The manual tray 26 is held at the opening position in the horizontal direction. For example, the automatic duplex device 40 is rotated by 45 degrees from the closing position in the clockwise direction to be opened. At this time, the manual tray 26 is rotated by 45 degrees from the horizontal position in the clockwise direction with the second hinge 44 as the center. At the same time, the second toothed gear 47C rotates in the counterclockwise direction.

However, since the number of teeth of the second toothed gear 47C is more than that of the intermediary toothed gear 47B, an angle at which the manual tray 26 is rotated in the closing direction (in the counterclockwise direction) is smaller than 45 degrees. The manual tray 26 is held at a position inclined to a lower side with respect to the horizontal position. Even in this case, the angle may be an angle at which the sheet P does not slide down from the manual tray 26.

Figure 9:
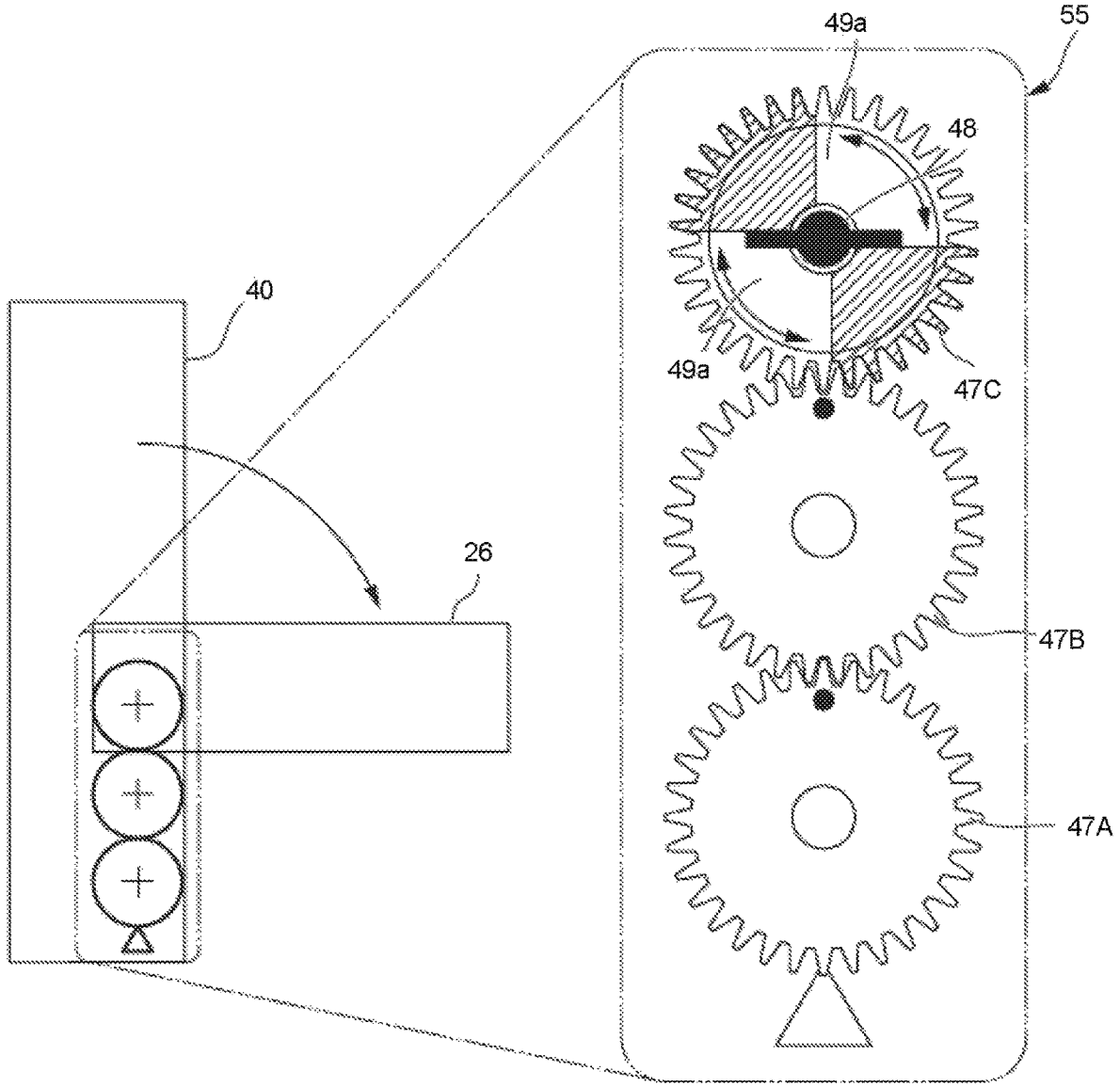
FIG. 9 is a view illustrating a gear device of an image forming apparatus according to a third embodiment.

FIG. 9 illustrates a gear device 55 of the image forming apparatus 10 according to a third embodiment.

In the gear device 55, the second toothed gear 47C has a smaller outer diameter size and a smaller number of teeth than the first toothed gear 47A and the intermediary toothed gear 47B. The manual tray 26 is held at the opening position in the horizontal direction. The automatic duplex device 40 is rotated by, for example, 45 degrees from the closing position in the clockwise direction to be opened. At this time, the manual tray 26 is rotated by 45 degrees from the horizontal position in the clockwise direction with the second hinge 44 as the center. At the same time, the second toothed gear 47C engaged with the intermediary toothed gear 47B is rotated in the counterclockwise direction. Since the number of teeth of the second toothed gear 47C is less than that of the intermediary toothed gear 47B, an angle at which the manual tray 26 is rotated in the closing direction (in the counterclockwise direction) becomes greater than 45 degrees. The manual tray 26 is held at a position inclined to a closing side with respect to the horizontal position. Even in this case, the sheet P is held on the manual tray 26 in the placement state and does not slide down.

In a case in which the automatic duplex device 40 and the manual tray 26 are located at the opening position, the removal of the jammed sheet within the apparatus main body 11 is carried out. The manual tray 26 is not used. In this state, if the sheet P drops from the manual tray 26, the angle of the manual tray 26 is not limited to the horizontal position. The manual tray 26 can be set to a suitable inclined angle.

Furthermore, the outer diameter dimension of the second toothed gear 47C may be set to be the same as that of the first toothed gear 47A and the intermediary toothed gear 47B, and the number of teeth of the second toothed gear 47C may be set to more or less. Even in this case, the same effect as the second embodiment and the third embodiment can be exerted.

Further, the size of the outer diameter dimension and the number of teeth of the intermediary toothed gear 47B may be different from the first toothed gear 47A and the second toothed gear 47C. The outer diameter dimension and the number of teeth of the intermediary toothed gear 47B can be optionally set.

Figure 10:
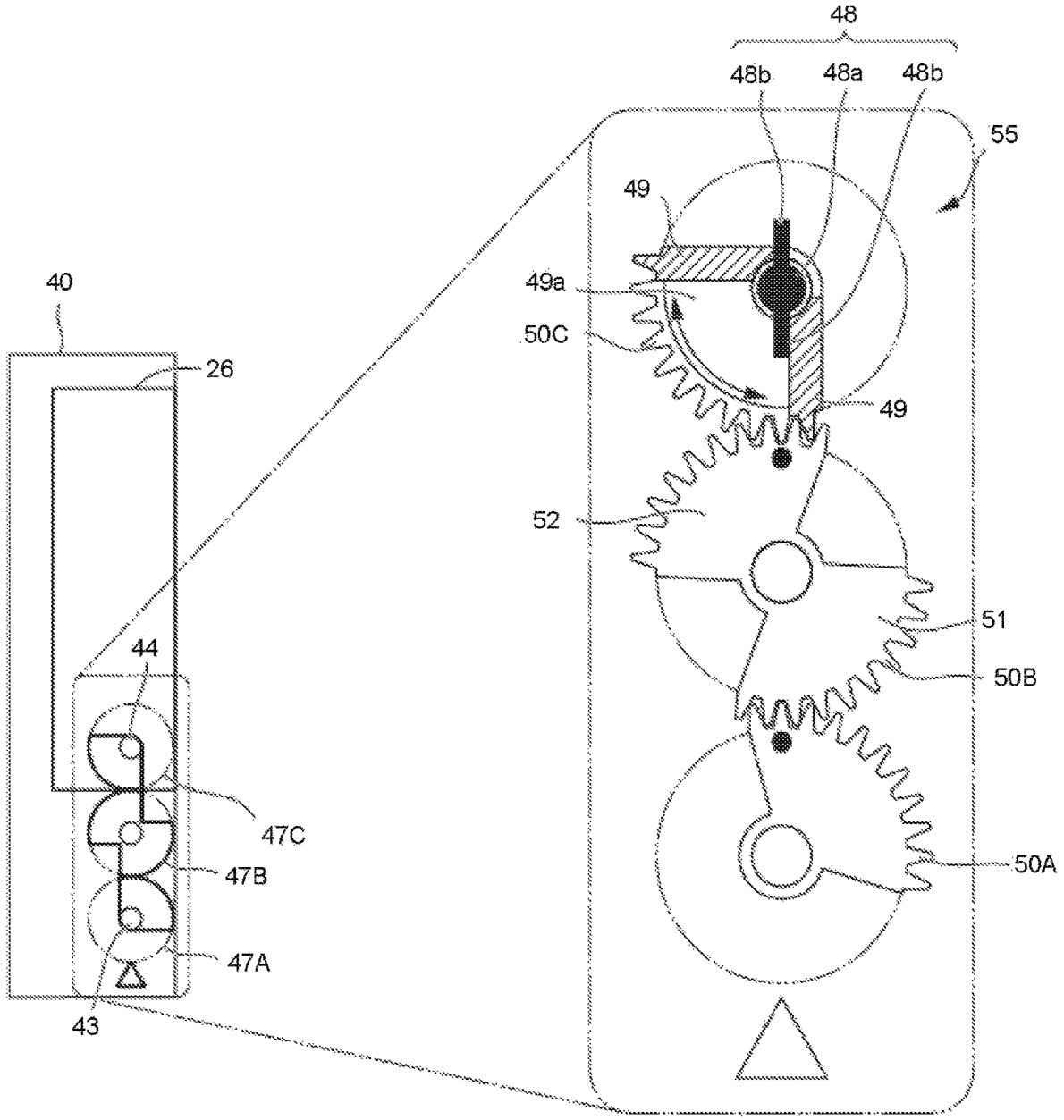
FIG. 10 is a view illustrating a gear device of an image forming apparatus according to a fourth embodiment.

FIG. 10 illustrates the image forming apparatus 10 according to a fourth embodiment.

In the fourth embodiment, the first toothed gear 47A, the intermediary toothed gear 47B, the second toothed gear 47C of the gear device 45 may not be used. A tooth-shaped section in a fan shape or drum shape arranged with only a part of a row of teeth in an area engaged with teeth of other toothed gears.

For example, instead of the gear device 45 in the first embodiment, a tooth-shaped section device 56 in which a first tooth-shaped section 50A, an intermediary tooth-shaped section 50B and a second tooth-shaped section 50C are engaged with each other is provided. The first tooth-shaped section 50A has an approximate fan shape arranged with teeth on the peripheral surface. An approximately fan-shaped angle range of the first tooth-shaped section 50A is set to, for example, about 90 degrees. The first tooth-shaped section 50A is fixedly arranged. The first tooth-shaped section 50A is arranged with a row of teeth in a range in which the intermediary tooth-shaped section 50B is engaged and rotated.

The intermediary tooth-shaped section 50B includes a first fan-shaped section 51 engaged with the first tooth-shaped section 50A and a second fan-shaped section 52 engaged with the second tooth-shaped section 50C. The first fan-shaped section 51 and the second fan-shaped section 52 are arranged with teeth on the approximately fan-shaped peripheral surfaces, respectively. The first fan-shaped section 51 and the second fan-shaped section 52 approximately face each other across the central shaft to be arranged in a drum shape. The approximately fan-shaped angle ranges of the first fan-shaped section 51 and the second fan-shaped section 52 are set to be, for example, about 90 degrees. In this way, the automatic duplex device 40 can be opened and closed from the vertical closing position to the opening position at which it is opened horizontally.

The second tooth-shaped section 50C has an approximate fan shape arranged with teeth on the peripheral surface. The second tooth-shaped section 50C is arranged with a row of teeth in a range in which it is engaged with the second fan-shaped section 52 of the intermediary tooth-shaped section 50B to rotate. The approximately fan-shaped angle range of the second tooth-shaped section 50C is set to be, for example, about 90 degrees. The space 49*a* for storing one abutting pin 48*b* of the coupling shaft 48 of the manual tray 26 is included inside the peripheral surface of the second tooth-shaped section 50C arranged with the teeth. The pressing sections 49 capable of pressing the abutting pins 48*b* are arranged at two sides of the space 49*a*. The pressing section 49 is formed as a part of the cylindrical portion. An angle between the pressing sections 49 at two sides is set to be, for example, about 90 degrees. The second toothed gear 47C may be arranged instead of the second tooth-shaped section 50C. In this way, the abutting pins 48*b* at two sides of the shaft section 48*a* of the coupling shaft 48 of the manual tray 26 can be pressed by the pressing section 49.

In the present embodiment, the manual tray 26 is opened to the horizontal position from the closing position of the automatic duplex device 40 and the manual tray 26. Thus, the coupling shaft 48 of the manual tray 26 is rotated such that the abutting pins 48*b* are turned from the vertical direction to the horizontal direction. Next, the automatic duplex device 40 is opened with the first hinge 43 as the center. Thus, the intermediary tooth-shaped section 50B of the tooth-shaped section device 51 also revolves while rotating in the clockwise direction. The second tooth-shaped section 50C engaged with the intermediary tooth-shaped section 50B rotates in the counterclockwise direction while revolving in the clockwise direction. In this way, the coupling shaft 48 of the manual tray 26 is pressed by the pressing section 49 of the second toothed gear 47C to be held in the horizontal state. Therefore, the sheet P placed on the manual tray 26 at the opening position can be prevented from sliding down. Moreover, since the automatic duplex device 40 is opened, the jammed sheet within the apparatus main body 11 can be removed or a component can be exchanged.

In each of the embodiments described above, the automatic duplex device 40 and the manual tray 26 arranged in the image forming apparatus 10 are described. The present embodiment can be applied to not only the image forming apparatus 10 but also an image processing apparatus. The image processing apparatus includes two fixing sections consisting of a fixing section for fixing and a fixing section for decoloring. The image processing apparatus can include not only formation of an image but also decoloring of an image.

In each of the embodiments described above, the gear devices 45, 54 and 55 are composed of three toothed gears, and the tooth-shaped section device 56 is composed of three tooth-shaped sections. However, the numbers of the toothed gears of the gear devices 45, 54 and 55 and the tooth-shaped sections of the tooth-shaped section device 56 may be any odd numbers of five or more in total without being limited to three. In this case, the numbers of the intermediary toothed gear 47B and the intermediary the tooth-shaped section 51B are an odd number. In each of the embodiments or modifications, the first toothed gear 47A and the first tooth-shaped section 50A are included in the first tooth section. The intermediary toothed gear 47B and the intermediary the tooth-shaped section 51B are included in the intermediary tooth section. The second toothed gear 47C and the second tooth-shaped section 50C are included in the second tooth section. The toothed gear devices 45, 54 and 55 and the tooth-shaped section device 56 are included in the tooth section device.

In each of the embodiments described above, the automatic duplex device 40 for opening and closing the apparatus main body 1 includes the reversal conveyance route 39 of the sheet P. The automatic duplex device 40 is included in an opening and closing cover. However, the opening and closing cover may not have the reversal conveyance route 39. The automatic duplex device 40 and the opening and closing cover are included in a first opening and closing member. The manual tray 26 is included in a second opening and closing member.

According to at least one embodiment described above, the downward inclination of the manual tray 26 located at the opening position can be prevented by the gear device 45 at the time of the opening operation of the automatic duplex device 40. It can be prevented that the sheet P drops from the manual tray 26. The constitution of the image forming apparatus 10 according to the embodiment is simple and small since the image forming apparatus 10 does not use a link member or a linear member in a conventional example. In a state where the automatic duplex device 40 is opened, the gear device 45 does not hinder work for removing a jammed sheet, component exchange or component repair.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. An image processing apparatus, comprising:

an apparatus main body configured to include a print section and conveyance mechanism;

a first openable member openable and closable with respect to the apparatus main body with a first hinge at a center thereof;

a second openable member openable and closable with a second hinge arranged in the first openable member at a center thereof;

a first section fixed coaxially with the first hinge;

a rotatable section fixed coaxially with the second hinge; and an intermediary member configured to rotate the rotatable section by rotating the first section.

2. The image processing apparatus according to claim 1, wherein in a state where the second openable member is held at an open position, when the first openable member is opened, the second openable member is held at an angle with respect to the open position.

3. The image processing apparatus according to claim 1, wherein when the second openable member is located at an open position and the first openable member is rotated from a closed position to the open position, the second openable member is rotated in a direction opposite to the first openable member.

4. The image processing apparatus according to claim 1, further comprising:

a coupling shaft coupled with a rotational shaft of the second openable member and a pressing section forming a space for storing the coupling shaft are arranged in the rotatable section, and an inclination angle of the second openable member being adjusted in cooperation with the pressing section and the coupling shaft depending on the rotation of the rotatable section.

5. The image processing apparatus according to claim 1, wherein the first section, the intermediary member, and the rotatable section each comprise a toothed gear.

6. The image processing apparatus according to claim 1, wherein the first openable member is an openable cover of the apparatus main body, and the second openable member is a manual tray.

7. The image processing apparatus according to claim 6, wherein the openable cover is an automatic duplex device arranged with a reversal conveyance route for reversing the sheet to convey the reversed sheet.

8. An image processing apparatus, comprising:

an automatic document feeder arranged at an upper part of an apparatus main body of the image processing apparatus;

an apparatus main body configured to include a print section and conveyance mechanism;

a first openable member openable and closable with respect to the apparatus main body with a first hinge at a center thereof;

a second openable member openable and closable with a second hinge arranged in the first openable member at a center thereof;

a first section fixed coaxially with the first hinge;

a rotatable section fixed coaxially with the second hinge; and an intermediary member configured to rotate the rotatable section by rotating the first section.

9. The image processing apparatus according to claim 8, wherein in a state where the second openable member is held at an open position, when the first openable member is opened, the second openable member is held at an angle with respect to the open position.

10. The image processing apparatus according to claim 8, wherein when the second openable member is located at an open position and the first openable member is rotated from a closed position to the open position, the second openable member is rotated in a direction opposite to the first openable member.

11. The image processing apparatus according to claim 8, further comprising:

a coupling shaft coupled with a rotational shaft of the second openable member and a pressing section forming a space for storing the coupling shaft are arranged in the rotatable section, and an inclination angle of the second openable member being adjusted in cooperation with the pressing section and the coupling shaft depending on the rotation of the rotatable section.

12. The image processing apparatus according to claim 8, wherein the first section, the intermediary member, and the rotatable section each comprise a belt or link.

13. An image processing apparatus, comprising:

a document table comprising a transparent glass arranged at an upper part of an apparatus main body of the image processing apparatus;

an automatic document feeder arranged on the document table;

a scanner section arranged at a lower part of the automatic document feeder;

an apparatus main body configured to include a print section and conveyance mechanism;

a first openable member openable and closable with respect to an apparatus main body with a first hinge at a center thereof;

a second openable member openable and closable with a second hinge arranged in the first openable member at a center thereof;

a first section fixed coaxially with the first hinge;

a rotatable section fixed coaxially with the second hinge; and an intermediary member configured to rotate the rotatable section by rotating the first section.

14. The image processing apparatus according to claim 13, wherein the first section, the intermediary member, and the rotatable section each comprise a toothed gear.

15. The image processing apparatus according to claim 14, wherein a total number of teeth of the first section, the intermediary member, and the rotatable section is an odd number.

16. The image processing apparatus according to claim 14, wherein a number of teeth of the first section, the intermediary member, and the rotatable are equal with each other.

* * * * *